US009359129B1

(12) United States Patent
Royt

(10) Patent No.: US 9,359,129 B1
(45) Date of Patent: Jun. 7, 2016

(54) AUTOMATIC LOCK FOR CARGO CONTAINER

(71) Applicant: Peck & Hale, L.L.C., West Sayville, NY (US)

(72) Inventor: Joseph Royt, Fresh Meadows, NY (US)

(73) Assignee: Peck & Hale, L.L.C., West Sayville, NY (US)

( * ) Notice: Subject to any disclaimer, the term of this patent is extended or adjusted under 35 U.S.C. 154(b) by 0 days.

(21) Appl. No.: 14/601,603

(22) Filed: Jan. 21, 2015

Related U.S. Application Data

(60) Provisional application No. 61/929,579, filed on Jan. 21, 2014.

(51) Int. Cl.
*B65D 88/02* (2006.01)
*B65D 21/02* (2006.01)
*B65D 90/00* (2006.01)

(52) U.S. Cl.
CPC ..... *B65D 88/022* (2013.01); *B65D 21/0204* (2013.01); *B65D 90/0006* (2013.01)

(58) Field of Classification Search
CPC ..... B60P 7/13; B60P 7/132; B65D 90/0006; B65D 90/0013; B65D 90/0026; B65D 88/022; B65D 88/121; B61D 45/007; B66C 1/663
See application file for complete search history.

(56) References Cited

U.S. PATENT DOCUMENTS

| | | | | |
|---|---|---|---|---|
| 5,020,947 | A | 6/1991 | Marcelius | |
| 5,570,981 | A * | 11/1996 | Brewster | B61D 45/007 410/69 |
| 5,613,814 | A * | 3/1997 | Jackson | B60P 7/13 410/69 |
| 5,782,511 | A * | 7/1998 | Schwarz | E05C 19/02 292/198 |
| 6,974,164 | B2 * | 12/2005 | Brewster | B60P 7/13 292/104 |
| 7,014,234 | B2 | 3/2006 | Walker | |
| 7,056,081 | B2 | 6/2006 | Kelly | |
| 7,114,898 | B2 | 10/2006 | Brewster | |
| 7,637,704 | B2 * | 12/2009 | Morin | B61D 45/007 410/69 |
| 8,007,214 | B2 | 8/2011 | Brewster | |
| 8,177,463 | B2 | 5/2012 | Walker | |
| 8,342,786 | B2 | 1/2013 | Kelly | |
| 8,458,861 | B2 * | 6/2013 | Ostberg | B60P 7/132 24/287 |
| 8,523,501 | B2 | 9/2013 | Kelly | |
| 8,684,644 | B2 * | 4/2014 | Metternich | B60P 7/13 410/77 |
| 8,827,612 | B2 | 9/2014 | Kelly | |
| 2010/0290855 | A1 * | 11/2010 | Strien | B65D 90/0006 410/77 |
| 2010/0303573 | A1 * | 12/2010 | Brewster | B61D 45/007 410/69 |

* cited by examiner

*Primary Examiner* — Daniel Wiley
(74) *Attorney, Agent, or Firm* — Schroeder Law PC

(57) ABSTRACT

An automatic lock for interconnecting cargo containers. The lock includes a pin assembly located in, and extending from, each of the bottom corner fittings of the container. The lock further includes a receiver assembly located in each of the top corner fittings of the container for engaging the pin assembly, thereby securing the upper container to said lower container.

13 Claims, 25 Drawing Sheets

ACL Hoist Position

Locking Pin in Landed Position

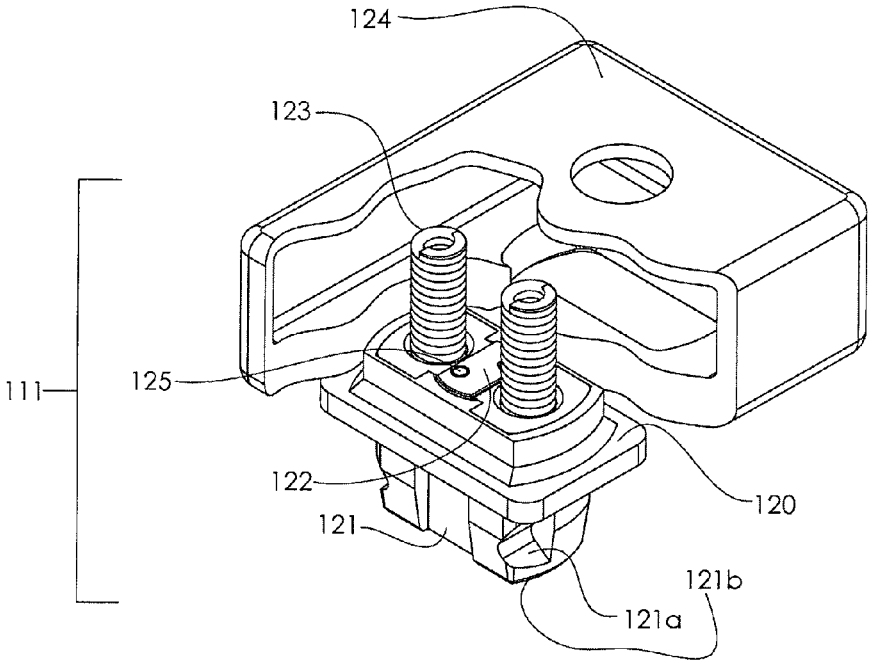
Figure 7 - Locking Pin Assembly

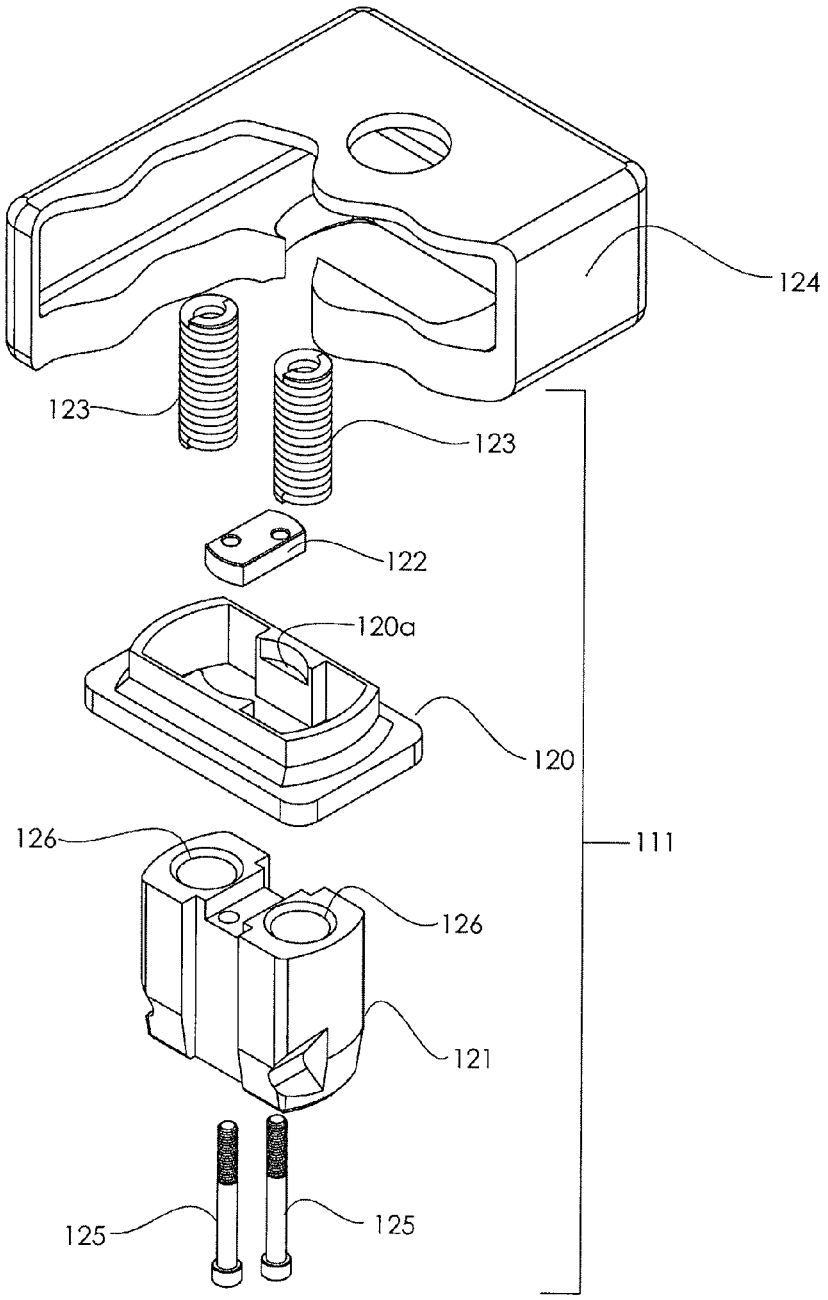
Figure 8 - Locking Pin Assembly (Exploded)

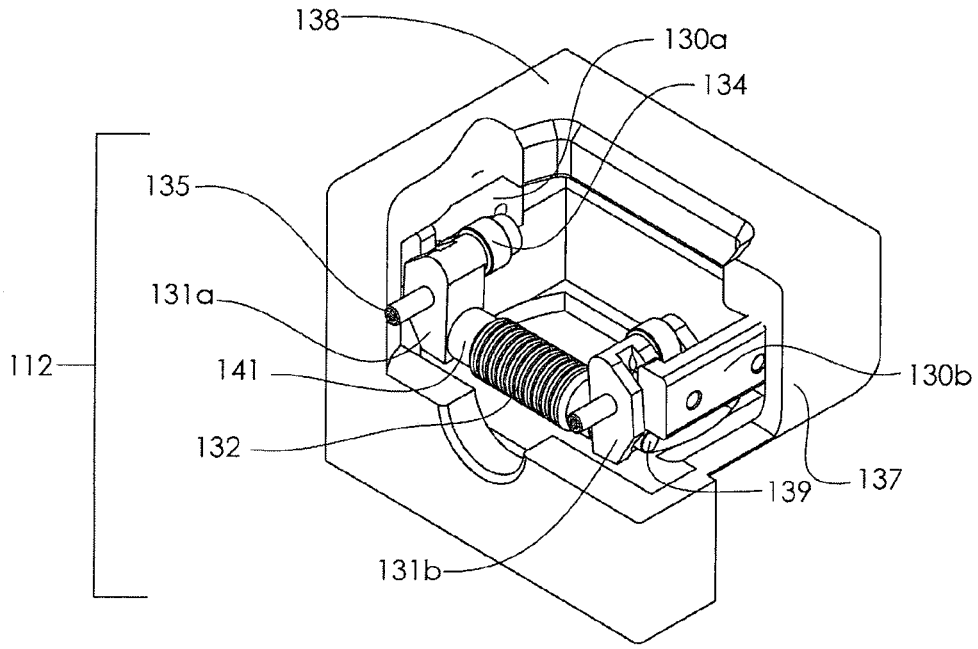
Figure 9 - Locking Receiver Assembly

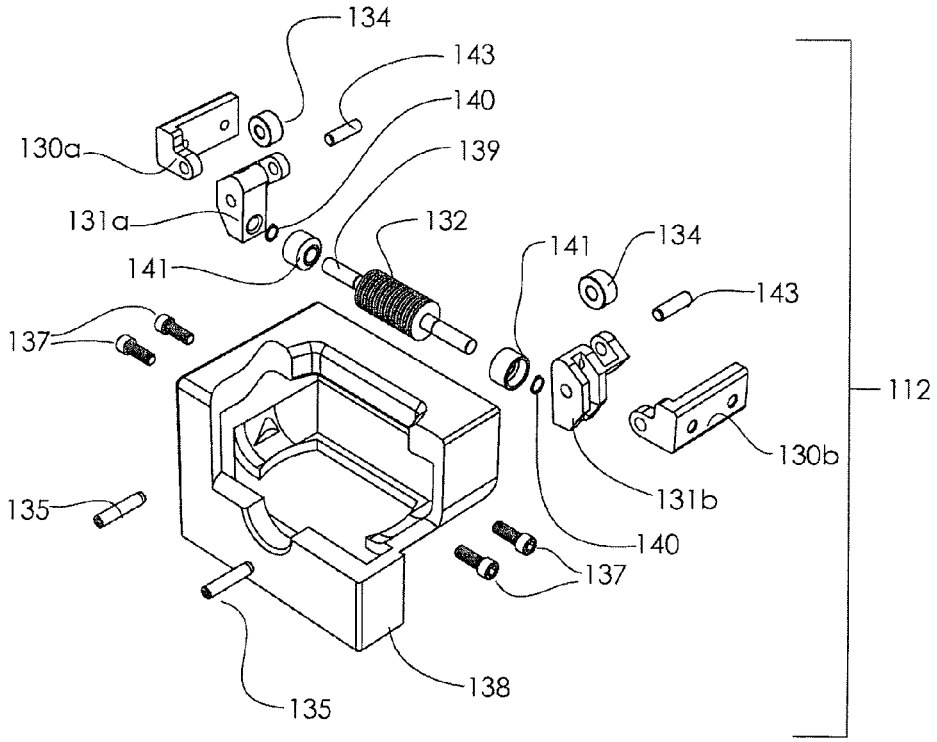
Figure 10 - Locking Receiver Assembly (Exploded)

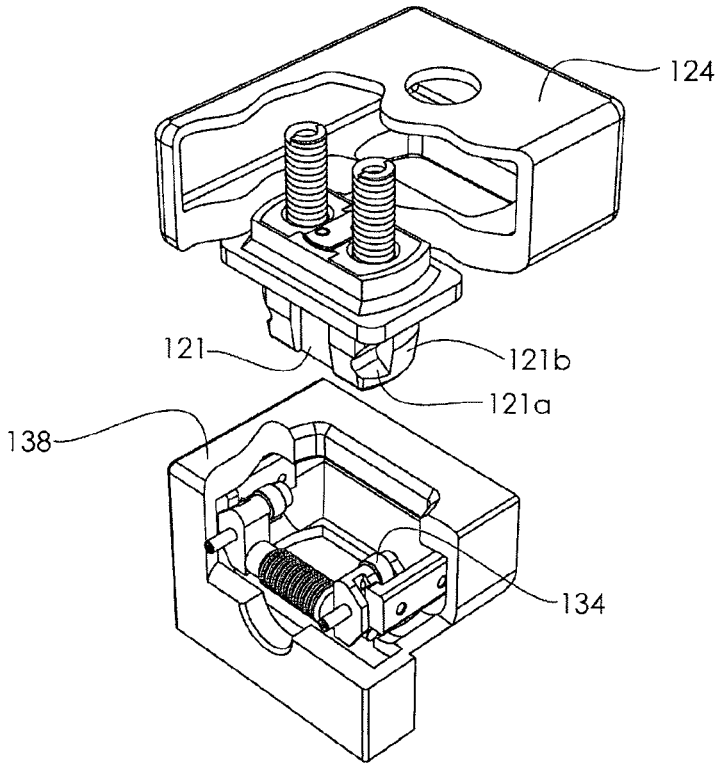
Figure 11 - ACL Hoist Position

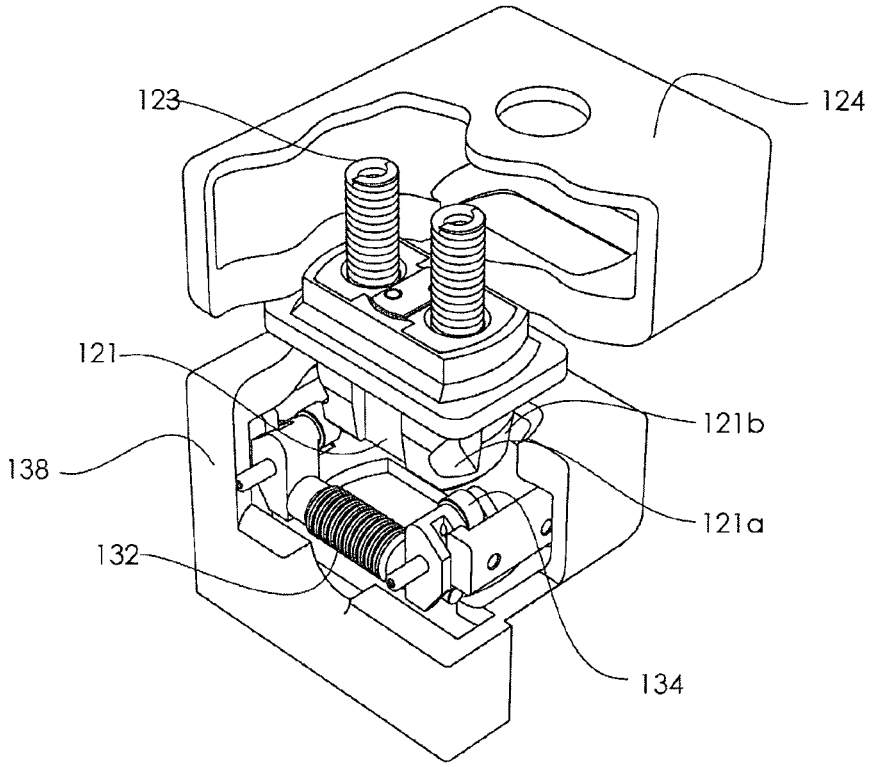
Figure 12 - ACL Pre-Landed Position

Figure 13 - Locking Pin in Landed Position
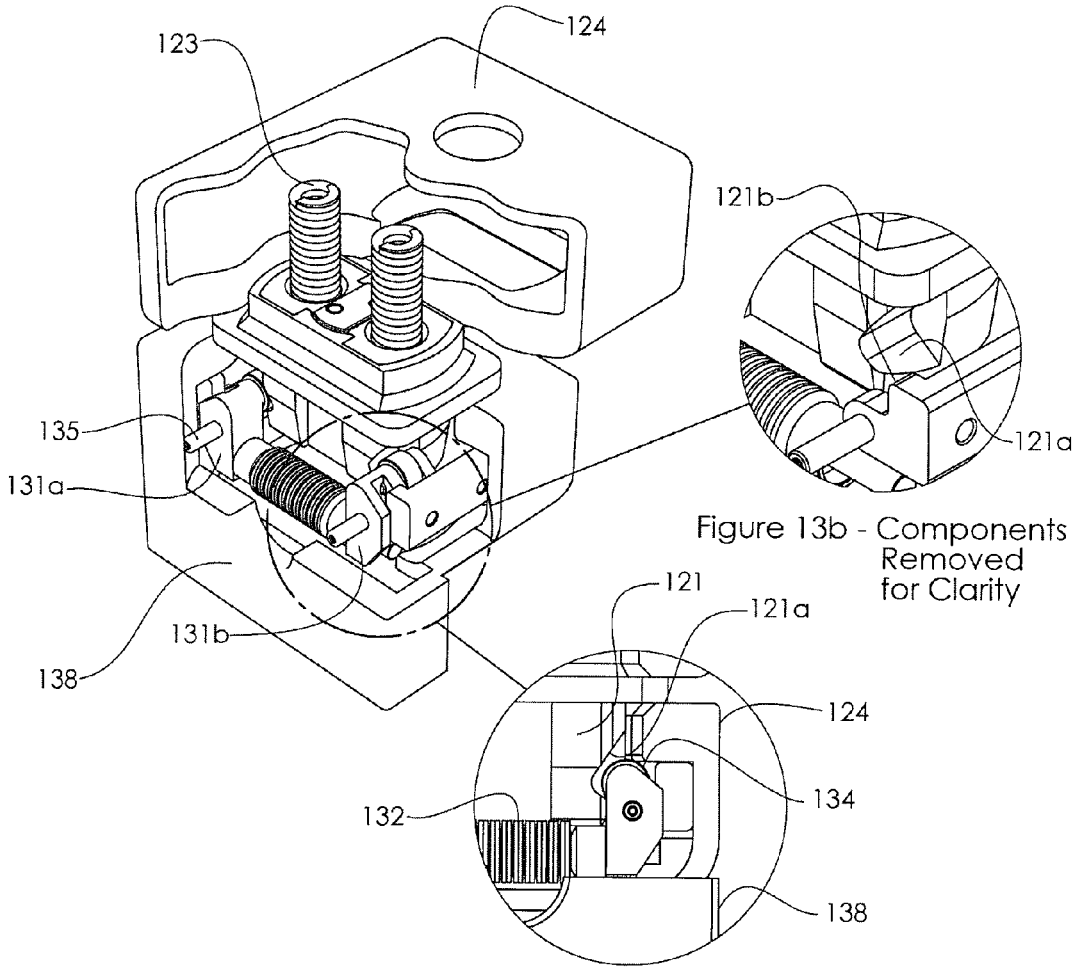
Figure 13b - Components Removed for Clarity
Figure 13a - Detail of Locking Pin in Landed Position

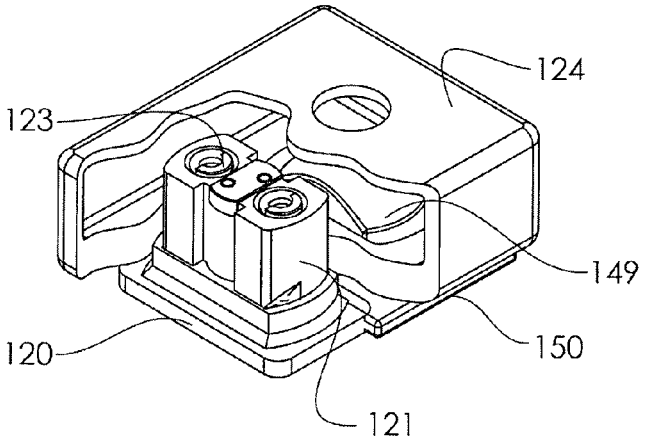
Figure 14 - Locking Pin Landed On Floor Well Of Rail Car
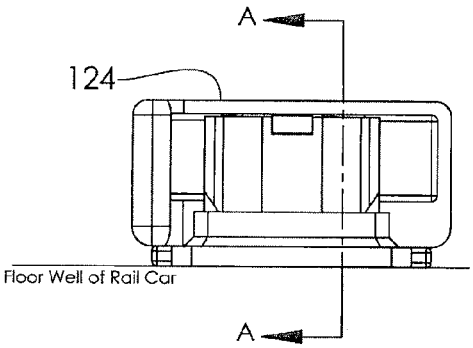
Figure 14a
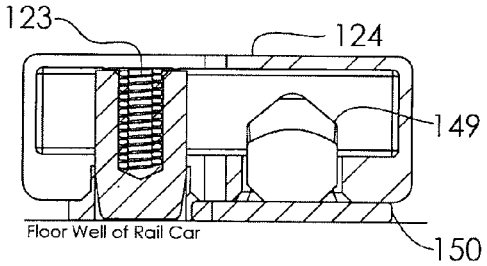
Figure 14b

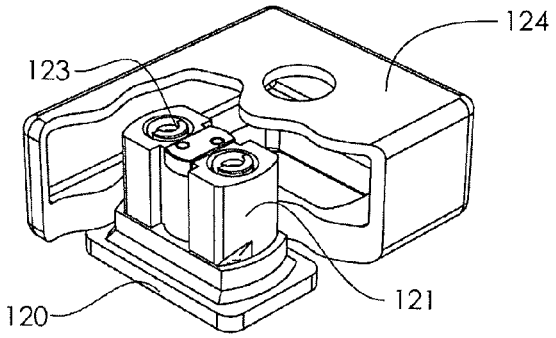
Figure 15 - Locking Pin Landed On Ground
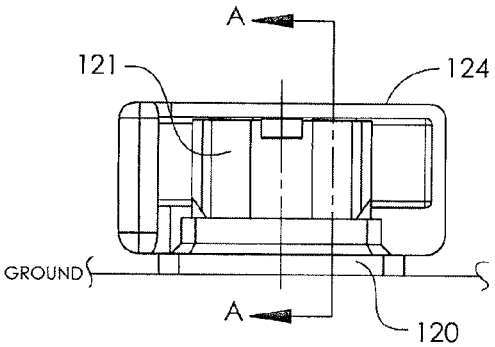
Figure 15a
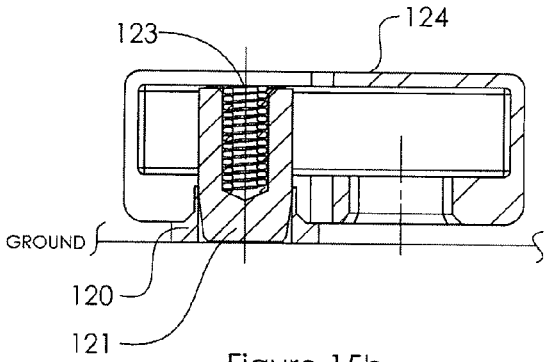
Figure 15b

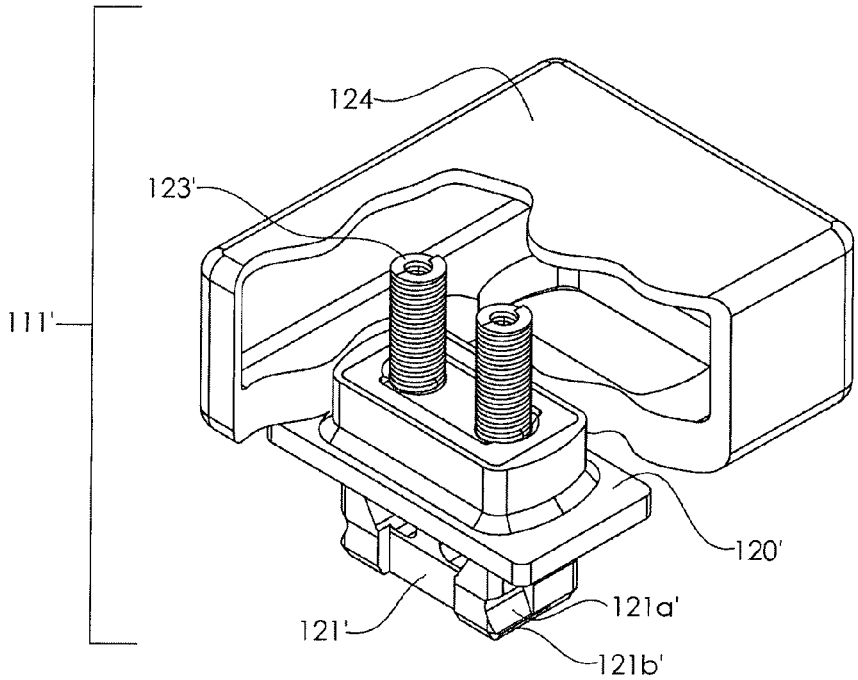
Figure 17 - Locking Pin Assembly

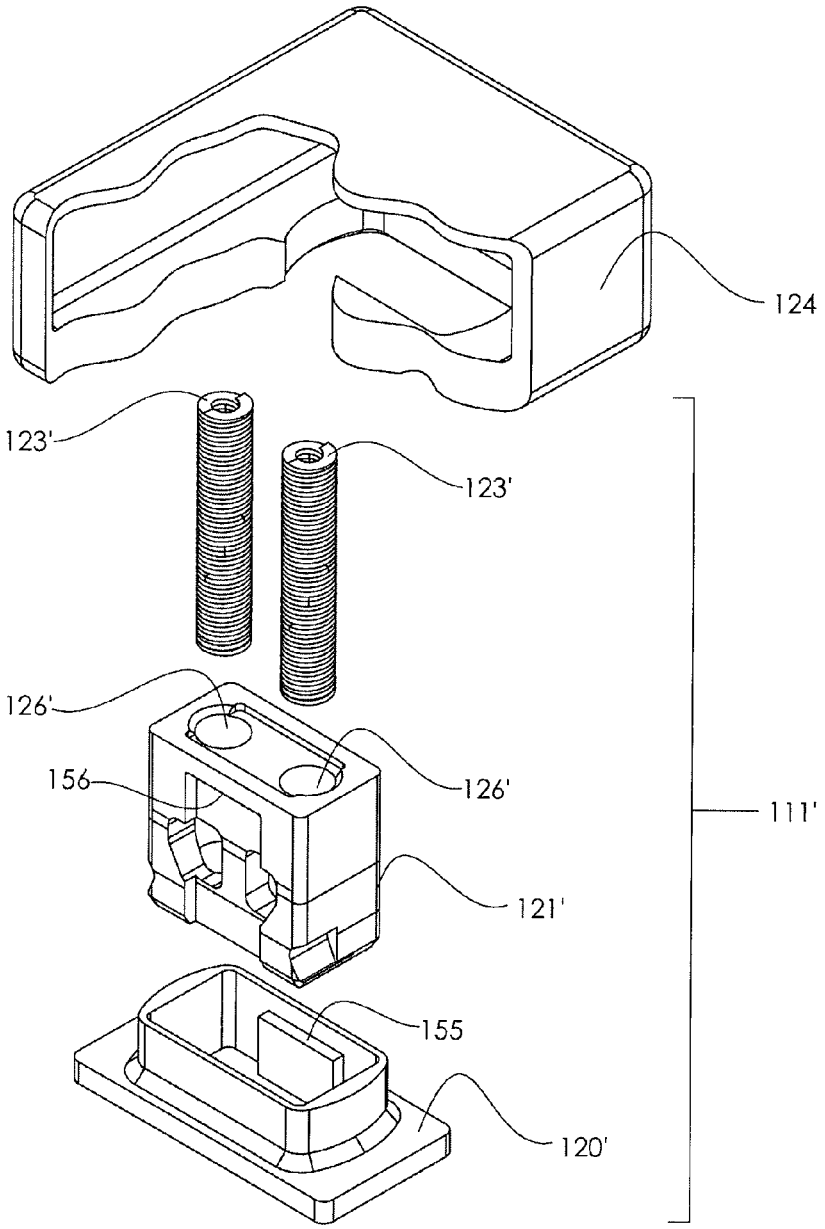
Figure 18 - Locking Pin Assembly (Exploded)

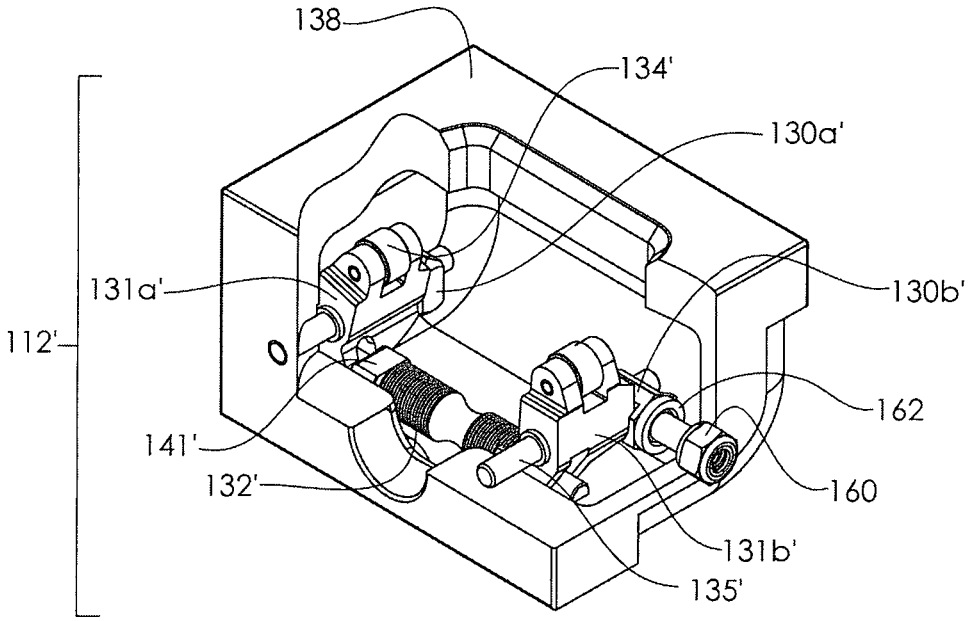
Figure 19 - Locking Receiver Assembly

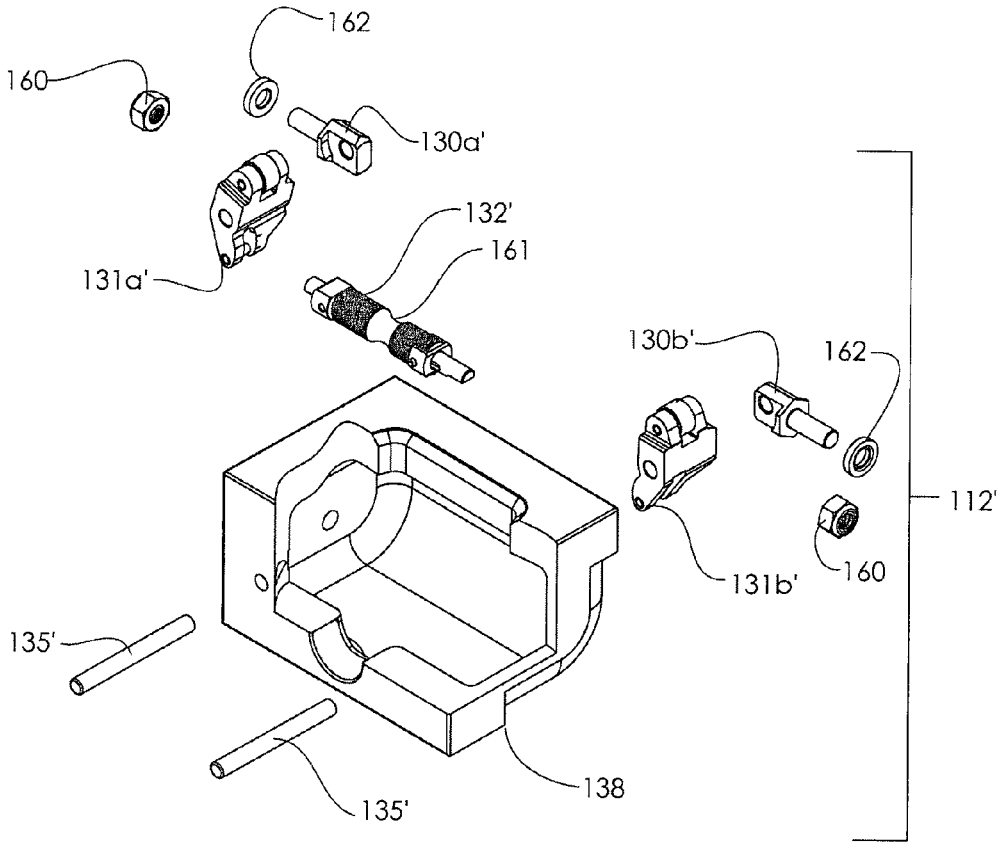
Figure 20 - Locking Receiver Assembly (Exploded)

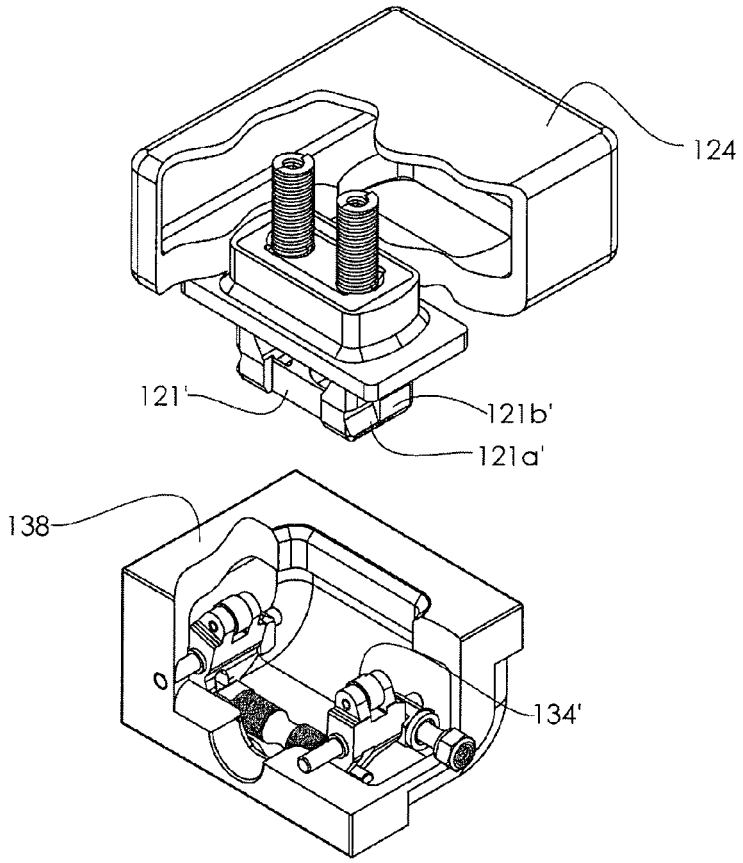
Figure 21 - ACL Hoist Position

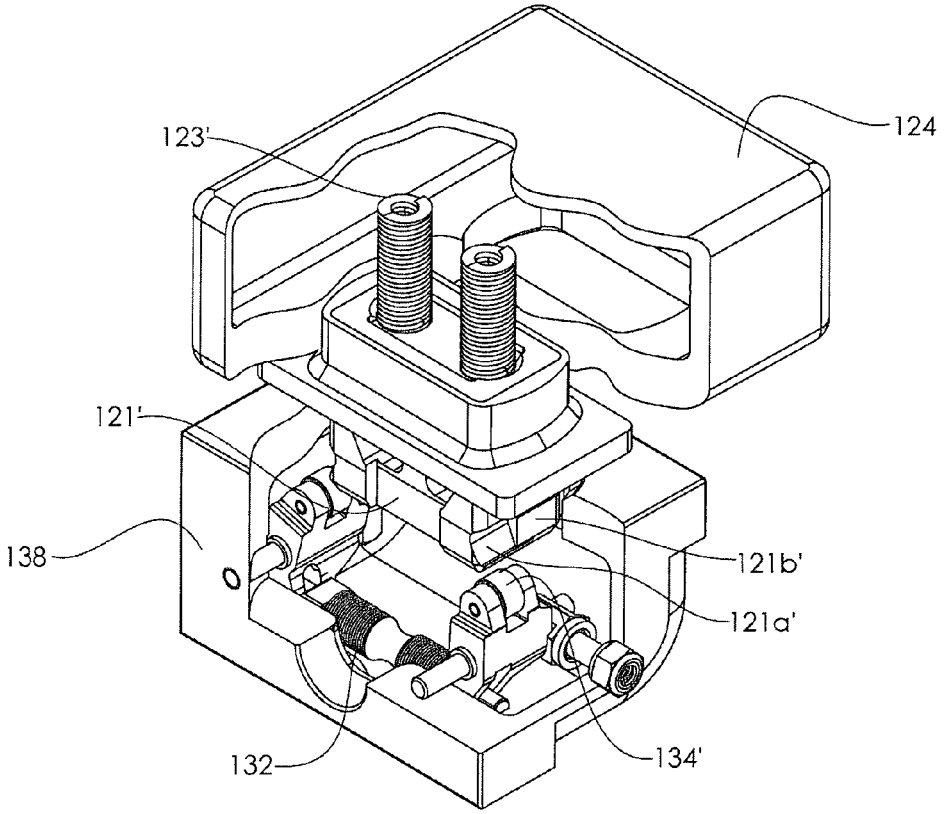
Figure 22 - ACL Pre-Landed Position

Figure 23 - Locking Pin in Landed Position (Some components removed for clarity)

Figure 23a - Detail of Locking Pin in Landed Position

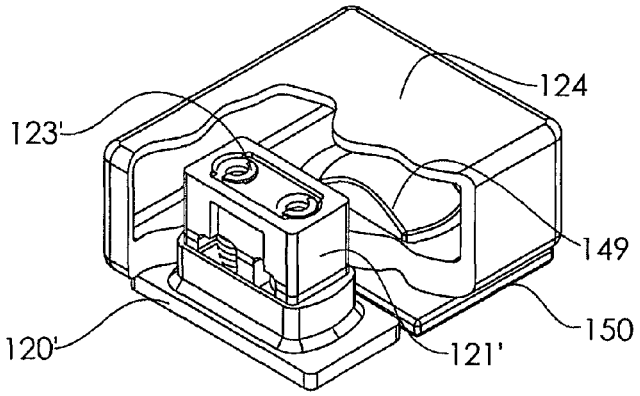
Figure 24 - Locking Pin Landed On Floor Well Of Rail Car
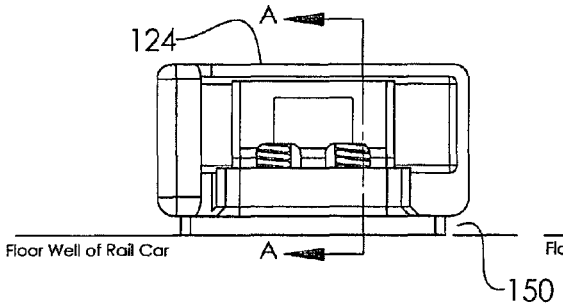
Figure 24a
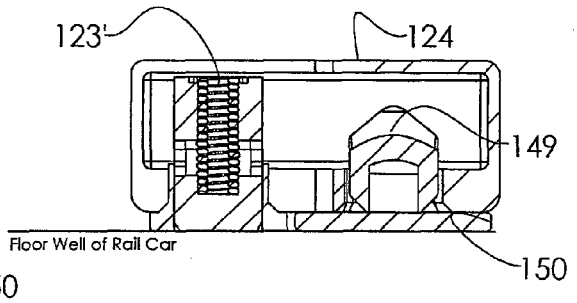
Figure 24b

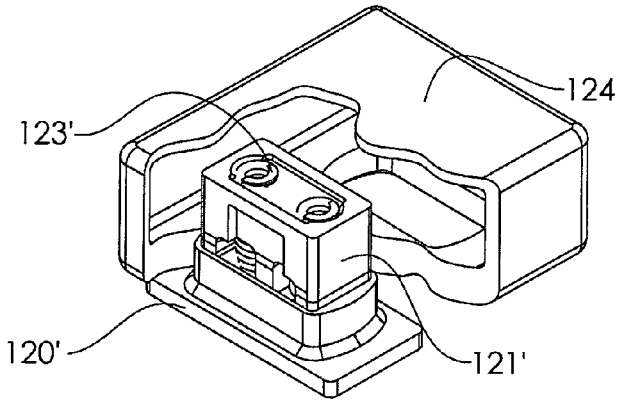
Figure 25 - Locking Pin Landed On Ground
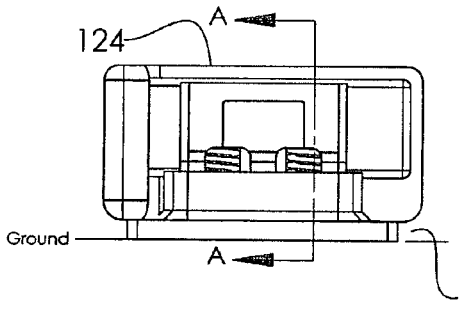
Figure 25a
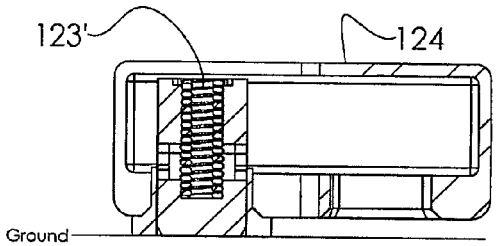
Figure 25b

AUTOMATIC LOCK FOR CARGO CONTAINER

BACKGROUND OF THE INVENTION

The present invention relates to the interlocking of stacked cargo containers and, more particularly, to automatic locks which are secured to and travel with the container.

The prior art includes various devices for interconnecting stacked cargo containers. These devices include manual locks, semi-automatic locks, and automatic locks. As will be recognized to those skilled in the art, manual locking devices must be manually installed within the corner fitting, are manually locked, are manually unlocked, and are then manually removed from the corner fitting. Semi-automatic devices must be manually installed in the corner fitting, provide automatic locking but must be manually unlocked, and are then manually removed from the corner fitting. Finally, automatic devices must be manually installed in the corner fitting, provide automatically locking and unlocking, and are then manually removed from the corner fitting.

Although the art has advanced from manual locks to semi-automatic locks to automatic locks, and although each new design has provided certain additional benefits, today's fully automatic locks still have certain drawbacks. First, many prior art automatic locks still require an operator to manually install and remove the device from the corner fitting of the container, resulting in additional time and cost during loading/unloading. Second, many prior art automatic devices are designed to release once a predetermined friction force is overcome during hoisting of the container. Due to such factors as tolerances, wear and abuse of the corner fittings, designs which rely upon release of friction forces can provide inconsistent results.

There is therefore a need in the art for an automatic lock which is capable of interconnecting two stacked containers, and of locking and unlocking without being adversely affected by factors such as tolerances, wear and abuse of the corner fittings, even when relying upon the overcoming of a friction force to release the device. The same automatic lock is preferably affixed to the container, thereby eliminating the need to install and remove such device during loading/unloading of the container.

SUMMARY OF THE INVENTION

The present invention, which addresses the needs of the prior art, provides an automatic lock for interconnecting an upper container stacked upon a lower container, the upper container including a bottom corner fitting located at each lower corner thereof and the lower container including a top corner fitting located at each upper corner thereof. The lock includes a pin assembly located within each bottom corner fitting, each pin assembly including a slidable downwardly-biased locking pin. Each locking pin includes a first pair of opposing engagement surfaces. The lock further includes a receiver assembly located within each top corner fitting, each receiver assembly including a second pair of opposing engagement surfaces. The second pair of engagement surfaces are spaced to receive the locking pin therebetween and to engage the first pair of opposing engagement surfaces whereby the bottom corner fitting is automatically secured to the top corner fitting when the upper container is stacked upon the lower container.

In one preferred embodiment, each engagement surface in one of the pairs includes a movable cam follower and each engagement surface in the other of the pairs includes a follower-receiving catch. In a further embodiment, the first pair of engagement surfaces are formed by a pair of catches located on opposing sides of the pin, and the second pair of engagement surfaces are formed by a pair of opposing pivotably-mounted cam followers, the pivotably-mounted cam followers being pivotal between an open position which allows passage of the pin thereby and a closed position which secures the pin therebetween. The pivotably-mounted cam followers are biased to the closed position.

As a result, the present invention provides an automatic lock which is capable of interconnecting two stacked containers, and of repeatedly and consistently locking and unlocking without being adversely affected by factors such as tolerances, wear and abuse of the corner fittings, even when relying upon the overcoming of a friction force to release the device. The automatic lock is affixed to the container, thereby eliminating the need to install and remove such device during loading/unloading of the container.

BRIEF DESCRIPTION OF THE DRAWINGS

FIG. 7 is a perspective cutaway view of a locking pin assembly in accordance with a first embodiment of the present invention installed in a bottom dual corner fitting;

FIG. 8 is an exploded perspective view of the locking pin assembly shown in FIG. 7;

FIG. 9 is a perspective cutaway view of a locking receiver assembly in accordance with a first embodiment of the present invention installed in a top single corner fitting;

FIG. 10 is an exploded perspective view of the locking receiver assembly shown in FIG. 9;

FIG. 11 is a perspective cutaway view showing the locking pin assembly of FIG. 7 hoisted above the locking receiver assembly of FIG. 9;

FIG. 12 is a perspective cutaway view showing the locking pin assembly of FIG. 7 in a pre-landed position with respect to the locking receiver assembly of FIG. 9;

FIG. 13 is a perspective cutaway view showing the locking pin assembly of FIG. 7 in a landed position with respect to the locking receiver assembly of FIG. 9;

FIG. 13*a* is an enlarged detail taken from FIG. 13;

FIG. 13*b* is another enlarged detail taken from FIG. 13;

FIG. 14 is a perspective cutaway view showing the locking pin assembly of FIG. 7 landed on the floor of a well-car;

FIG. 14*a* is an elevational view of the locking pin assembly shown in FIG. 14;

FIG. 14*b* is a sectional view taken along lines A-A of FIG. 14*a;*

FIG. 15 is a perspective cutaway view showing the locking pin assembly of FIG. 7 landed on the ground;

FIG. 15*a* is an elevational view of the locking pin assembly shown in FIG. 15; and FIG. 15*b* is a sectional view taken along lines A-A of FIG. 15*a*.

FIG. 17 is a perspective cutaway view of a locking pin assembly in accordance with the second embodiment of present invention installed in a bottom dual corner fitting;

FIG. 18 is an exploded perspective view of the locking pin assembly shown in FIG. 17;

FIG. 19 is a perspective cutaway view of a locking receiver assembly in accordance with a second embodiment of the present invention installed in a top single corner fitting;

FIG. 20 is an exploded perspective view of the locking receiver assembly shown in FIG. 19;

FIG. 21 is a perspective cutaway view showing the locking pin assembly of FIG. 17 hoisted above the locking receiver assembly of FIG. 19;

FIG. 22 is a perspective cutaway view showing the locking pin assembly of FIG. 17 in a pre-landed position with respect to the locking receiver assembly of FIG. 19;

FIG. 23 is a perspective cutaway view showing the locking pin assembly of FIG. 17 in a landed position with respect to the locking receiver assembly of FIG. 19;

FIG. 23*a* is an enlarged detail taken from FIG. 23;

FIG. 24 is a perspective cutaway view showing the locking pin assembly of FIG. 17 landed on the floor of a well-car;

FIG. 24*a* is an elevational view of the locking pin assembly shown in FIG. 24;

FIG. 24*b* is a sectional view taken along lines A-A of FIG. 24*a;*

FIG. 25 is a perspective cutaway view showing the locking pin assembly of FIG. 17 landed on the ground;

FIG. 25*a* is an elevational view of the locking pin assembly shown in FIG. 25; and FIG. 25*b* is a sectional view taken along lines A-A of FIG. 25*a*.

DETAILED DESCRIPTION OF THE INVENTION

Figure 1:
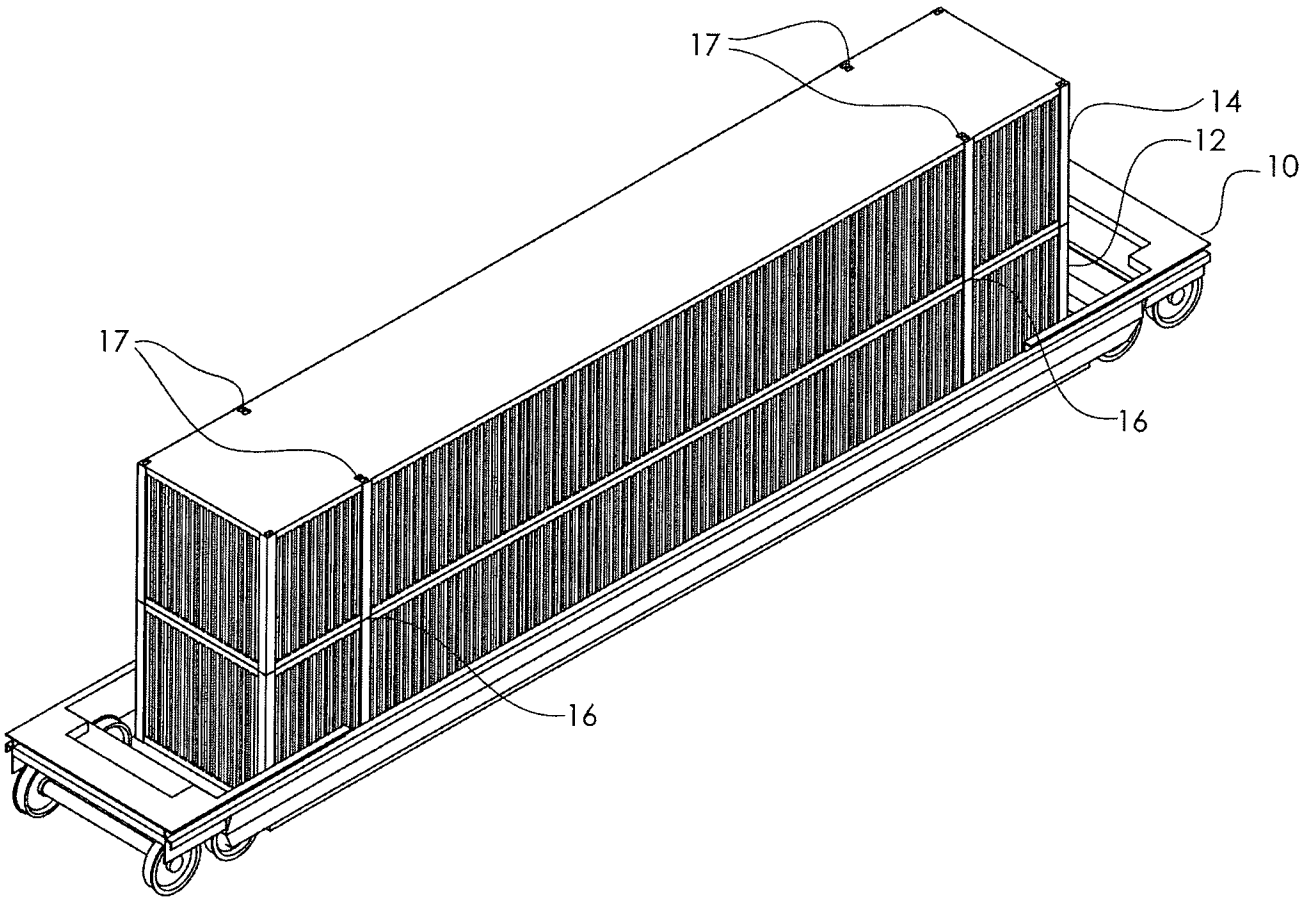
Figure 1 (Prior Art)
FIG. 1 is a perspective view of a typical well-car having two 53' domestic cargo containers stacked thereon.

It is commonplace in the rail industry to use what are commonly referred to as well-cars (also known as double-stack cars) to transport cargo containers. A typical well-car 10 is shown in FIG. 1. A lower container 12 sits within the well of the car, while an upper container 14 rests upon lower container 12. Those skilled in the art will recognize containers 12, 14 to be 53' U.S. Domestic Containers, which is a common container used in the rail industry. These 53' containers are all made with a standard size and configuration, including the location of four bottom dual corner fittings 16 located on the lower surface and four top single corner fittings 17 located on the upper surface.

Figure 2:
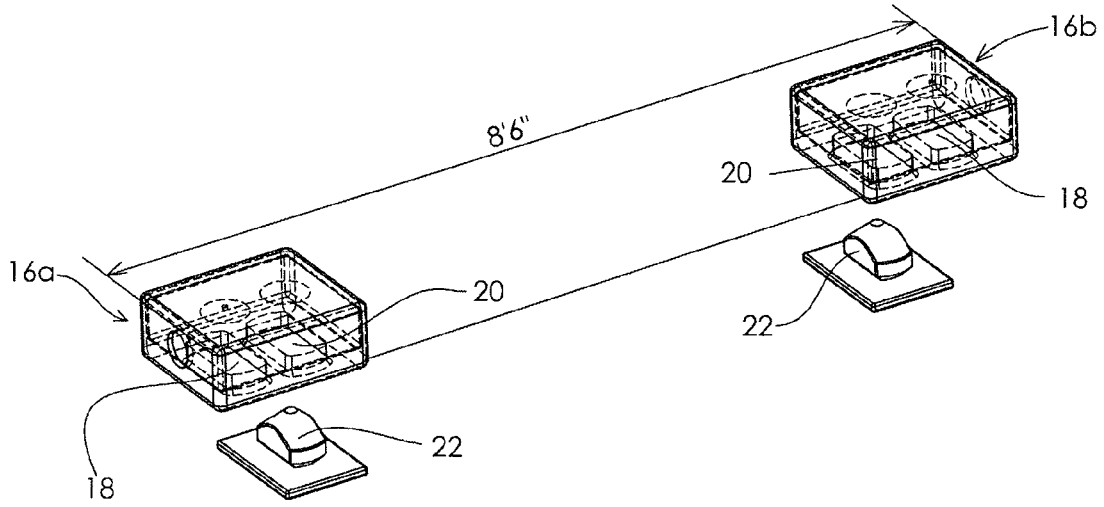
Figure 2 (Prior Art)
FIG. 2 is a schematical representation of the corner fittings of a domestic cargo container interacting with the retainers located on the floor of a well-car.

Referring now to FIG. 2, each of containers 12, 14 is formed with a standard width of 8'-6". As best seen in FIG. 1, the corner fittings are located at the outer edges of the container, such that the distance from the outer edge of corner fitting 16*a* to the outer edge of corner fitting 16*b* is also 8'-6". Each of corner fittings 16 located on the lower surface of the domestic cargo container is formed with both an outboard opening 18 and an inboard opening 20. Located at the bottom of each well-car are four retainers 22, which are sized and located to engage and penetrate the inboard openings of the four corner fittings located on the bottom surface of container 12 when container 12 is lowered into the well of car 10. The combination of retainers 22 and the walls of the well-car ensure that container 12 is secure for transport. When a second container, e.g., container 14, is to be stacked upon container 12, it is industry practice today to use a plurality of twistlocks to interconnect and lock container 14 to container 12.

Figure 3:
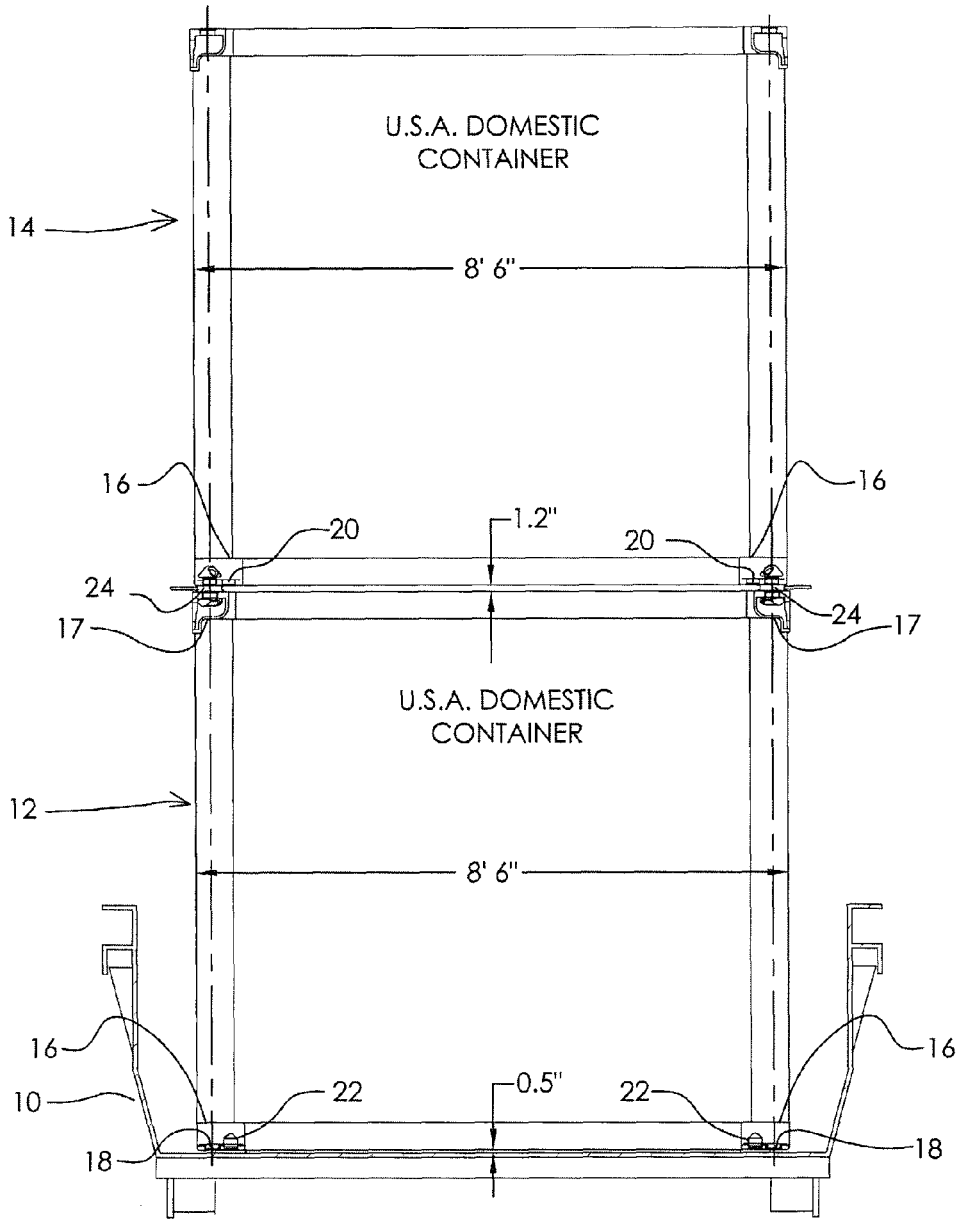
Figure 3 (Prior Art)
FIG. 3 is a schematical end view of a well-car showing two stacked domestic cargo containers.

The stacking of two 53' domestic containers is best illustrated with reference to FIG. 3. As shown, retainers 22 affixed to the bottom of well car 10 penetrate inboard openings 20 in each of the four corner fittings 16 located on the bottom surface of container 12. The outboard openings 18 located in these same corner fittings are not used in this application. Four twistlocks 24 are then used to interconnect and lock container 14 to container 12.

Figure 4:
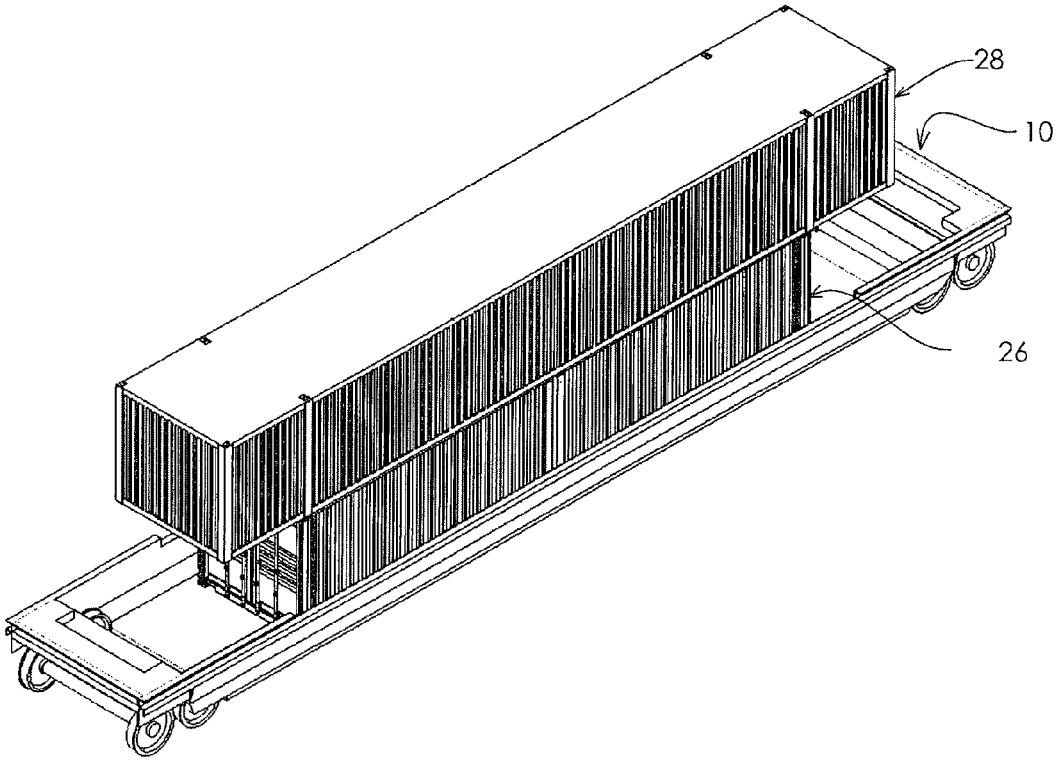
Figure 4 (Prior Art)
FIG. 4 is a perspective view of a typical well-car having a 53' domestic cargo container stacked upon a 40' ISO cargo container.
Figure 5:
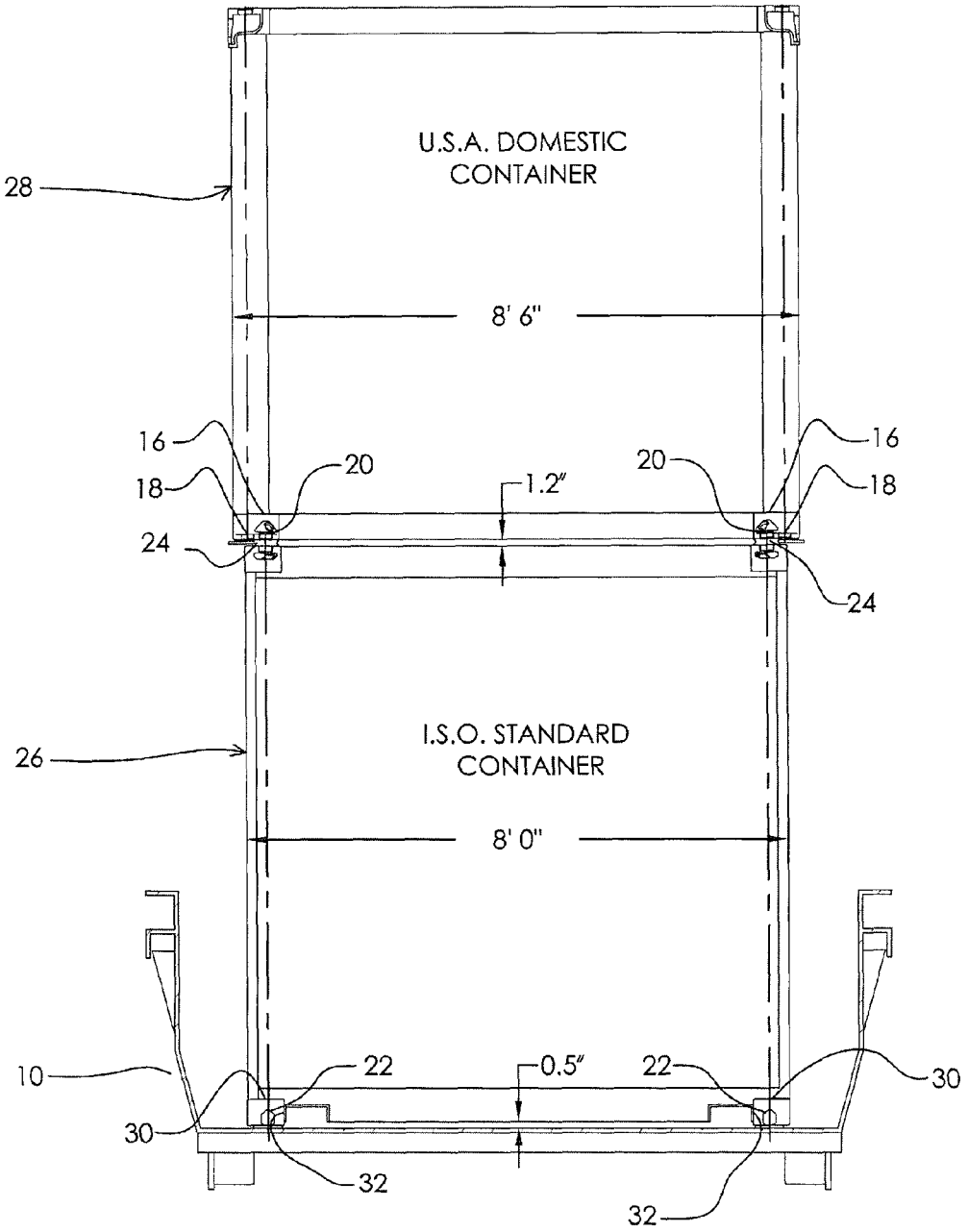
Figure 5 (Prior Art)
FIG. 5 is a schematical end view of a well-car showing a domestic cargo container stacked upon an ISO cargo container.

The rail industry also uses 8' wide containers referred to as ISO standard containers. These ISO standard containers can be formed with nominal lengths of 10', 20', 30' and 40'. A 40' ISO container 26 is shown in FIG. 4. As shown, container 26 is positioned within the well of car 10. A 53' domestic container 28 is stacked thereon. This stacked relationship is best illustrated with reference to FIG. 5. As illustrated in FIG. 5, container 26 includes a plurality of corner fittings 30, all of which are formed with a single opening 32. Openings 32 are located to engage retainers 22 in the same manner that openings 20 of corner fittings 16 engaged retainers 22. A plurality of twistlocks 24 are used to interconnect and lock container 28 to container 26. Inasmuch as container 26 is narrower in profile, inboard openings 20 of corner fittings 16 of container 28 receive one of the locking cones of the twistlocks. In this application, outboard openings 18 of corner fittings 16 of container 28 are not used.

It has been discovered herein that the dual opening configuration of the corner fittings on the lower surface of domestic containers can be utilized in the design of an automatic lock for such containers. More particularly, the present invention provides a novel automatic locking system which cooperates with the outboard opening of each bottom dual corner fitting, and with the single opening of each top corner fitting. As will be explained further hereinbelow, such an arrangement still allows the domestic container to be used in the applications described above. More particularly, the novel arrangement of the present invention will not interfere with retainers 22 of well-car 10 engaging inboard openings 20 of corner fittings 16 when the domestic container is placed within the well of car 10. In such a scenario, the novel locking arrangement of the present invention will simply remain unused. In the arrangement shown in FIG. 5, the novel locking arrangement of the present invention will also remain in unused condition without interfering with the usage of four twistlocks to interconnect and lock container 28 to container 26. However, in the common application shown in FIG. 3 (wherein a domestic container is stacked upon another domestic container), the novel automatic locking arrangement of the present invention will eliminate the need for twistlocks 24, thus saving time and money during loading and unloading of the containers.

Those skilled in the art will appreciate that an automatic locking system must be designed in such a manner as to not interfere with the ability of the pick cone of a container lifting device to engage the top corner fittings of the container. This, of course, seriously limits the design possibilities for such automatic locking systems. Many prior art systems simply provide the locking mechanism in the bottom corner fittings of the container, and engage an existing surface of the top corner fitting in the underlying container. This then leads to the problem of non-repeatable and inconsistent performance due to such factors as tolerances, wear and abuse of the adjacent top corner fitting. The present invention addresses and overcomes these prior art deficiencies by locating at least a portion of the automatic locking system within the top corner fitting of the lower container in such a manner as to provide clearance for the pick cone to engage the top corner fitting during loading/unloading, and in such a manner as to provide opposing engagement surfaces for securement to a portion of the locking system extending downward from the bottom corner fitting of the upper container. Inasmuch as the present automatic locking system is not relying upon direct engagement with the existing walls/surfaces of the top corner fitting, the prior art problems resulting from tolerances, wear and abuse of the corner fitting do not arise. Moreover, the novel design of employing opposing engagement surfaces ensures that the biasing forces utilized to lock the containers are within a desired operating range and do not hinder and/or slow the loading/unloading of the containers.

Figures 6, 6A:
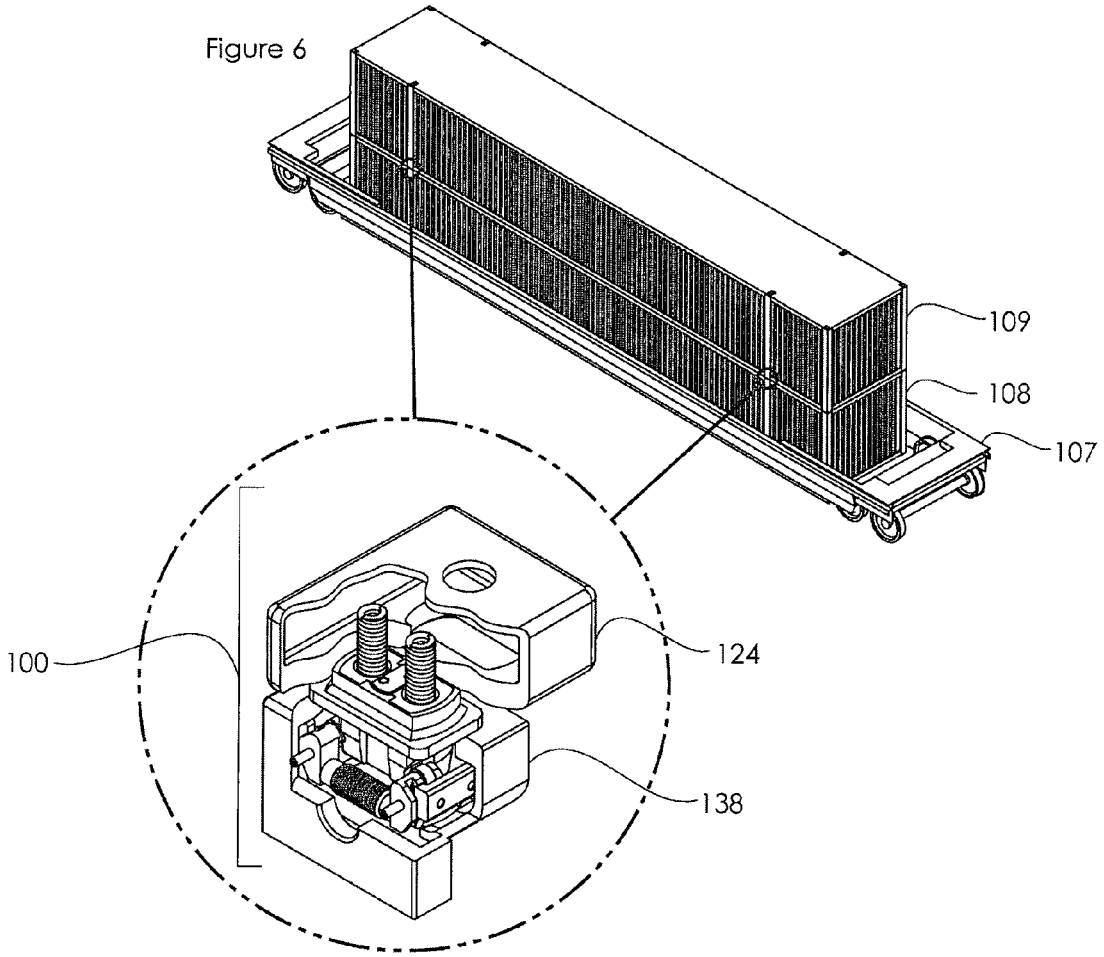
FIG. 6 is perspective view of a typical well-car having two 53' domestic cargo containers stacked thereon, the containers incorporating a first embodiment of the automatic locks of the present invention.
FIG. 6*a* is an enlarged detail taken from FIG. 6.

Referring now to FIGS. 6-6*a*, an automatic lock 100 formed in accordance with a first embodiment of the present invention is shown. As shown, locks 100 are incorporated into bottom dual corner fittings 124 of domestic container 109 and into top single corner fittings 138 of domestic container 108. FIG. 6 shows containers 108, 109 loaded onto well-car 107. As discussed further hereinbelow, lock 100 includes a locking pin assembly 111 and a locking receiver assembly 112. In one preferred embodiment, each of the four bottom dual corner fittings 124 of containers 108, 109 includes a locking pin assembly 111 located in the outboard opening thereof, while each of the four top single corner fittings 138 of containers 108, 109 includes a locking receiver assembly 112.

Referring now to FIGS. 7-8, locking pin assembly 111 preferably includes a guide flange 120, a sliding cam-wedge pin 121, a pin stop 122, and a biasing member, e.g., compression springs 123. Guide flange 120 is aligned and fixed to the outboard opening of corner fitting 124. As mentioned, the bottom dual corner fitting is a permanent fixture of a domestic container.

Guide flange 120 may be affixed to the underside of corner fitting 124 via welding, clamping or with mechanical fasteners. Guide flange 120 preferably houses and allows vertical sliding motion of cam-wedge pin 121. Pin stop 122 is secured to cam-wedge pin 121 with two screws 125. The screws are inserted into cam-wedge pin 121, and then threaded into pin stop 122. In the disclosed embodiment, pin stop 122 is configured to rest on surface 120*a* of guide flange 120. This arrangement both captures cam-wedge pin 121 and allows vertical sliding motion within guide flange 120. Of course, it is contemplated herein that cam-wedge pin 121 may be slidably coupled to guide flange 120 with other suitable hardware. Compression springs 123 are preferably fitted into recesses 126 of cam-wedge pin 121. When this assembly is installed in corner fitting 124, compression springs 123 will contact the top inner surface of corner fitting 124, thus creating a vertical force on cam-wedge pin 121. Compressions springs 123 are preferably selected to ensure that this vertical force is sufficient to hold cam-wedge pin 121 in an extended "home" position to allow coupling with locking receiver assembly 112.

Referring next to FIGS. 9-10, automatic locking receiver assembly 112 preferably includes a pair of opposing support brackets 130*a*, 130*b*, a pair of opposing swing arms 131*a*, 131*b*, a biasing member, e.g., a pre-tensioned stack of disc springs 132, and a pair of opposing engagement surfaces, e.g., cam followers 134. In one preferred embodiment, cam followers 134 are in the form of rollers. Locking receiver assembly 112 is aligned and fixed inside top corner fitting 138. As mentioned, the top single corner fitting is a permanent fixture of a domestic container.

As shown, support brackets 130*a*, 130*b* may be fastened to the interior vertical walls of top single corner fitting 138 via screws 137. In this regard, corner fitting 138 may be configured and/or modified to permit passage of four screws 137 through its interior vertical walls. Swing arms 131*a*, 131*b* are attached to support brackets 130*a*, 130*b*, respectively, using dowel pin connectors 135. Due to the space restrictions and size of the openings in corner fitting 138, swing arms 131*a*, 131*b* may be attached to support brackets 130*a*, 130*b* after the support brackets have been secured to corner fitting 138. Thus, corner fittings 138 may be configured and/or modified to permit passage of dowel connectors 135 through the front interior vertical walls thereof, whereupon such dowel pins engage and rotatably connect the swing arms to the pre-positioned support brackets. In one preferred embodiment, the openings through the front vertical walls of corner fitting 138 are sized to support the ends of the dowel connectors. In certain applications, this may provide additional rigidity to the locking receiver assembly.

A disc spring shaft 139 spans between swing arms 131*a*, 131*b*. Each end of shaft 139 is fixed to the respective swing arm by, for example, a retaining ring 140. Shaft 139 supports the pre-tensioned stack of disc springs 132 and a pair of opposing disc spring compression sleeves 141. A cam follower 134 is attached to each swing arm 131*a*, 131*b* via a dowel pin 143.

Referring now to FIG. 11, a container lifting device (crane, hoist) will hoist and thereafter position the hoisted container over another container such that the respective corner fittings of the two containers are vertically aligned. This operation will thus vertically pre-align cam-wedge pin 121 of locking pin assembly 111 located on container 109 with cam followers 134 of receiver assembly 112 located on container 108. Referring next to FIG. 12, cam-wedge pin 121 enters the aperture of top corner fitting 138 resulting in contact between tapered walls 121*b* of cam-wedge pin 121 and cam followers 134 of receiver assembly 112. Springs 123 preferably provide a sufficient vertical force on cam-wedge pin 121 to retain cam-wedge pin 121 in its extended "home" position when contact is made with opposing cam followers 134. It will be appreciated by those skilled in the art that the use of opposing engagement surfaces in the present design facilitates the alignment of the pin as the upper container is lowered onto the lower container.

Referring to FIGS. 13-13*b*, tapered walls 121*b* of cam-wedge pin 121 push the opposing cam followers 134 outward. This induces a torsional motion in opposing swing arms 131*a*, 131*b*, which further compresses pre-tensioned disc springs 132. Once tapered walls 121*b* of cam-wedge pin 121 penetrate past cam followers 134 (see FIG. 13*a*), swing arms 131*a*, 131, rotate clockwise and counterclockwise, respectively, causing cam followers 134 to contact a pair of opposing engagement surfaces located on pin 121, e.g., notches 121*a*, thereby releasably locking pin assembly 111 to receiver assembly 112. This sequence will occur at each of the four corner fitting locations on the container. In one preferred embodiment, disc springs 132 provide a non-linear load/deflection relationship. Of course, it is contemplated herein that disc springs 132 could be replaced by other types of springs or elastic elements.

When container 109 is lifted off of container 108, the reverse sequence occurs at each of the four corner fitting locations. More particularly, the lifting force used to hoist container 109 is sufficient to overcome the tension of disc springs 132, thus allowing swing arms 131*a*, 131*b* to rotate counterclockwise and clockwise, respectively, and opposing cam followers 134 to move outward, which in turn allows cam-wedge pin 121 to disengage from receiver assembly 112. Thus, the combination of locking pin assembly 111 and locking receiver assembly 112 may be utilized to lock an upper domestic freight container to a lower domestic freight container.

The novel design of the present invention also allows containers 108, 109 to be landed in a typical well-car or on the ground. As discussed herein, cam-wedge pin 121 is preferably configured to allow vertical displacement of the pin into the corner fitting. The weight of the container is preferably greater than the force of compression springs 123, thus permitting cam-wedge pin 121 to fully recess until flush with the bottom surface of guide flange 120. When the container is thereafter lifted, compression springs 123 returns the cam-wedge pin to its extended "home" position.

FIGS. 14-14*b* show corner fitting 124 interacting with a retainer 149 positioned on the floor of a well-car. As discussed hereinabove, the retainers located on the floor of the well-car penetrate and engage the inboard openings of bottom dual corner fittings 124. A plate 150 is typically used to support retainers 149. These plates generally have a thickness of approximately ½ inch. Flange 120 is preferably formed with a cross-sectional thickness equal to or less than the cross-sectional thickness of plate 150. This then allows full engagement of retainers 149 within the inboard openings of corner fittings 124, without any interference from flange 120.

Containers 108, 109 may also be landed on the ground. Referring to FIGS. 15-15*b*, the container is capable of being landed on the ground (concrete, dirt, etc.). When the container is landed on the ground, cam-wedge pin 121 is preferably capable of full retraction into bottom dual corner fitting 124. Upon contact with the ground, compression springs 123 are compressed to a position where the bottom surface of cam-wedge pin 121 is flush with the bottom surface of guide flange 120. When the container is thereafter lifted off the ground, compression springs 123 extend to their pre-tensioned state, thus returning cam-wedge pin 121 to its extended "home" position. This sequence will occur at each of the four bottom corner fitting locations on the container.

Figures 16, 16A:
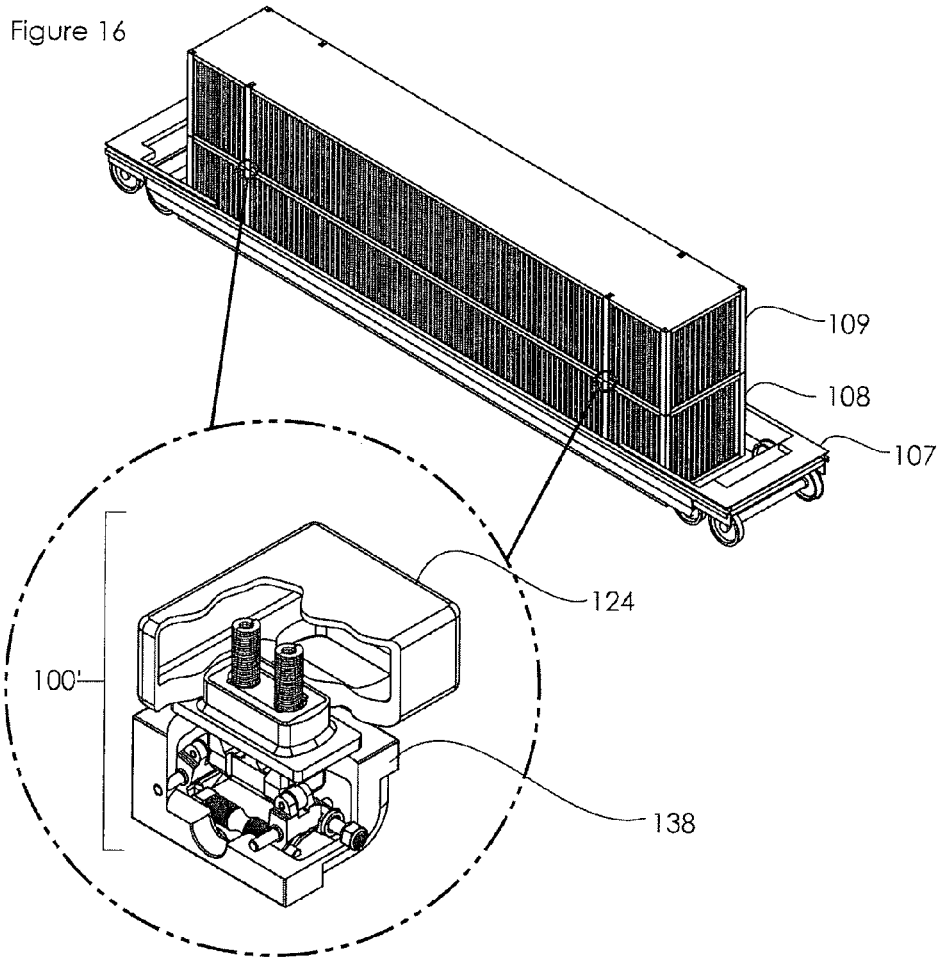
FIG. 16 is perspective view of a typical well-car having two 53' domestic cargo containers stacked thereon, the containers incorporating a second embodiment of the automatic locks of the present invention.
FIG. 16*a* is an enlarged detail taken from FIG. 16.

A second embodiment of the automatic lock of the present invention is shown in FIGS. 16-25*b*. Referring now to FIGS. 16-16*a*, an automatic lock 100' is shown. Locks 100' are incorporated into bottom dual corner fittings 124 of domestic container 109 and into top single corner fittings 138 of domestic container 108. FIG. 16 shows containers 108, 109 loaded onto well-car 107. As discussed further hereinbelow, lock 100' includes a locking pin assembly 111' and a locking receiver assembly 112'. In one preferred embodiment, each of the four bottom dual corner fittings 124 of containers 108, 109 includes a locking pin assembly 111' located in the outboard opening thereof, while each of the four top single corner fittings 138 of containers 108, 109 includes a locking receiver assembly 112'.

Referring now to FIGS. 17-18, locking pin assembly 111' preferably includes a guide flange 120', a sliding cam-wedge pin 121', and a biasing member, e.g., compression springs 123'. Guide flange 120' is aligned and fixed to the outboard opening of corner fitting 124. As mentioned, the bottom dual corner fitting is a permanent fixture of a domestic container.

Guide flange 120 may be affixed to the underside of corner fitting 124 via welding, clamping or with mechanical fasteners. Guide flange 120' preferably houses and allows vertical sliding motion of cam-wedge pin 121'. Instead of utilizing a pin stop, this second embodiment provides a pair of opposing blocks 155 on guide flange 120'. Blocks 155 are sized and located to engage shoulders 156 when pin 121' slides downward within guide flange 120', thus providing a positive stop. Compression springs 123' are preferably fitted into recesses 126' of cam-wedge pin 121'. When this assembly is installed in corner fitting 124, compression springs 123' will contact the top inner surface of corner fitting 124, thus creating a vertical force on cam-wedge pin 121'. Compressions springs 123' are preferably selected to ensure that this vertical force is sufficient to hold cam-wedge pin 121 in an extended "home" position to allow coupling with locking receiver assembly 112'.

Referring next to FIGS. 19-20, automatic locking receiver assembly 112' preferably includes a pair of opposing support brackets 130*a'*, 130*b'*, a pair of opposing swing arms 131*a'*, 131*b'*, a biasing member, e.g., a pre-tensioned stack of disc springs 132', and a pair of opposing engagement surfaces, e.g., cam followers 134'. In one preferred embodiment, cam followers 134' are in the form of rollers. Locking receiver assembly 112' is aligned and fixed inside corner fitting 138. As mentioned, the upper single corner fitting is a permanent fixture of a domestic container.

As shown, support brackets 130*a'*, 130*b'* may be fastened to the interior vertical walls of top single corner fitting 138 via a nut 160. In this regard, corner fitting 138 may be configured and/or modified to permit passage of the threaded shafts of support brackets 130*a'*, 130*b'* through its interior vertical walls. A seal 162 may be installed under nut 160 to limit the ingress of moisture and/or debris into the opening. Swing arms 131*a'*, 131*b'* are attached to support brackets 130*a'*, 130*b'*, respectively, using dowel connectors 135'. Due to the space restrictions and size of the openings in corner fitting 138, swing arms 131*a*, 131*b* may be attached to support brackets 130*a*, 130*b* after the support brackets have been secured to corner fitting 138. Thus, corner fittings 138 may be configured and/or modified to permit passage of dowel connectors 135' through the front interior vertical walls thereof, whereupon such dowels engage and rotatably connect the swing arms to the pre-positioned support brackets. In this second embodiment, the openings through the front vertical walls of corner fitting 138 are sized to support one end of each of the dowel pins. A disc spring shaft 139' spans between swing arms 131*a'*, 131*b'*. Each end of shaft 139' is fixed to the respective swing arm. Shaft 139' supports pre-tensioned stacks of disc springs 132', and preferably includes a spacer 161 positioned between the stacks. The spacer may be included to provide additional clearance for the pick cone to engage the top corner fitting. A cam follower 134' is attached to each swing arm 131*a'*, 131*b'*.

Referring now to FIG. 21, a container lifting device (crane, hoist) will hoist and thereafter position the hoisted container over another container such that the respective corner fittings of the two containers are vertically aligned. This operation will thus vertically pre-align cam-wedge pin 121' of locking pin assembly 111' located on container 109 with cam followers 134' of receiver assembly 112' located on container 108. Referring next to FIG. 12, cam-wedge pin 121' enters the aperture of top corner fitting 138 resulting in contact between tapered walls 121*b'* of cam-wedge pin 121' and cam followers 134' of receiver assembly 112'. Springs 123' preferably provide a sufficient vertical force on cam-wedge pin 121' to retain cam-wedge pin 121' in its extended "home" position when contact is made with opposing cam followers 134'. As mentioned, the use of opposing engagement surfaces in the present design facilitates the alignment of the pin as the upper container is lowered onto the lower container.

Figure 23B:
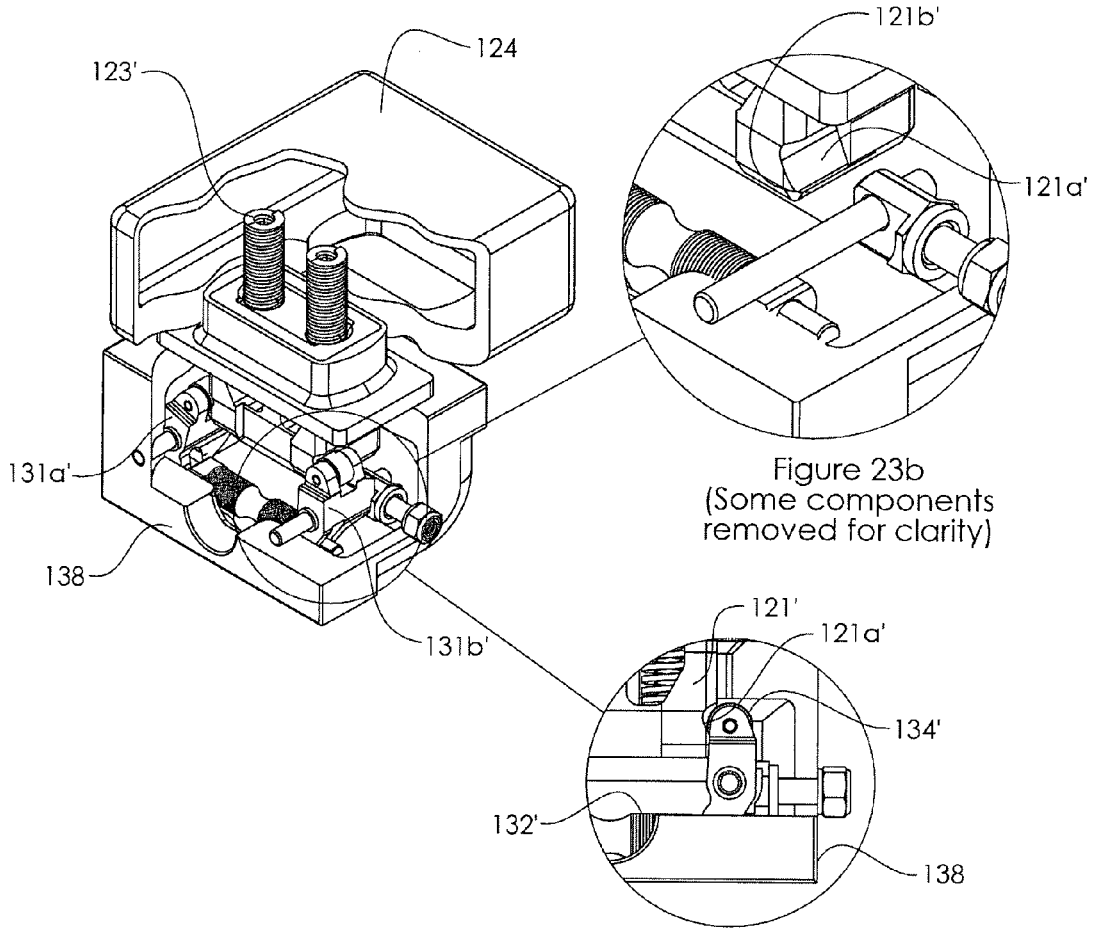
FIG. 23*b* is another enlarged detail taken from FIG. 23.

Referring to FIGS. 23-23*b*, tapered walls 121*b*' of cam-wedge pin 121' push the opposing cam followers 134' outward. This induces a torsional motion in opposing swing arms 131*a*', 131*b*', which further compresses pre-tensioned disc springs 132'. Once tapered walls 121*b*' of cam-wedge pin 121' penetrate past cam followers 134' (see FIG. 23*a*), swing arms 131*a*', 131', rotate clockwise and counterclockwise, respectively, causing cam followers 134' to contact a pair of opposing engagement surfaces located on pin 121', e.g., notches 121*a*', thereby releasably locking pin assembly 111' to receiver assembly 112'. This sequence will occur at each of the four corner fitting locations on the container. In one preferred embodiment, disc springs 132' provide a non-linear load/deflection relationship. Of course, it is contemplated herein that disc springs 132' could be replaced by other types of springs or elastic elements.

When container 109 is lifted off of container 108, the reverse sequence occurs at each of the four corner fitting locations. More particularly, the lifting force used to hoist container 109 is sufficient to overcome the tension of disc springs 132', thus allowing swing arms 131*a*', 131*b*' to rotate counterclockwise and clockwise, respectively, and opposing cam followers 134' to move outward, which in turn allows cam-wedge pin 121' to disengage from receiver assembly 112'. Thus, the combination of locking pin assembly 111' and locking receiver assembly 112' may be utilized to lock an upper domestic freight container to a lower domestic freight container.

The novel design of the present invention also allows containers 108, 109 to be landed in a typical well-car or on the ground. As discussed herein, cam-wedge pin 121' is preferably configured to allow vertical displacement of the pin into the corner fitting. The weight of the container is preferably greater than the force of compression springs 123', thus permitting cam-wedge pin 121' to fully recess until flush with the bottom surface of guide flange 120'. When the container is thereafter lifted, compression springs 123' returns the cam-wedge pin to its extended "home" position.

FIGS. 24-24*b* show corner fitting 124 interacting with a retainer 149 positioned on the floor of a well-car. As discussed hereinabove, the retainers located on the floor of the well-car penetrate and engage the inboard openings of bottom dual corner fittings 124. A plate 150 is typically used to support retainers 149. These plates generally have a thickness of approximately ½ inch. Flange 120' is preferably formed with a cross-sectional thickness equal to or less than the cross-sectional thickness of plate 150. This then allows full engagement of retainers 149 within the inboard openings of corner fittings 124, without any interference from flange 120'.

Containers 108, 109 may also be landed on the ground. Referring to FIGS. 25-25*b*, the container is capable of being landed on the ground (concrete, dirt, etc.). When the container is landed on the ground, cam-wedge pin 121' is preferably capable of full retraction into bottom dual corner fitting 124. Upon contact with the ground, compression springs 123' are compressed to a position where the bottom surface of cam-wedge pin 121' is flush with the bottom surface of guide flange 120'. When the container is thereafter lifted off the ground, compression springs 123' extend to their pre-tensioned state, thus returning cam-wedge pin 121' to its extended "home" position. This sequence will occur at each of the four bottom corner fitting locations on the container.

In addition to the domestic containers described hereinabove, it is contemplated herein that the automatic lock of the present invention may be utilized in other applications and to interconnect other containers used in the different forms of cargo transportation.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

What is claimed is:

1. An automatic lock interconnecting an upper container stacked upon a lower container, said upper container including a bottom corner fitting located at each lower corner thereof, said lower container including a top corner fitting located at each upper corner thereof, comprising:

a pin assembly located within each said bottom corner fitting, each said pin assembly including a slidable, downwardly-biased locking pin, each said locking pin including a first pair of opposing engagement surfaces; and a receiver assembly located within each said top corner fitting, each said receiver assembly including:

opposing first and second swing arms, each pivotable between an open and closed position, and rotatable about an axis located between opposing first and second ends of each swing arm, each first end comprising a second engagement surface, and a first biasing member for urging the first ends of said swing arms inwards and into the closed position, wherein said second pair of engagement surfaces are spaced to receive said locking pin therebetween when in the open position, and are configured to engage said first pair of opposing engagement surfaces when the swing arms are moved to the closed position such that said bottom corner fitting is automatically secured to said top corner fitting when said upper container is stacked upon said lower container.

2. The lock according to claim 1, wherein said first biasing member extends between the respective second ends of said first and second swing arms, wherein said first biasing member biases the second ends outward to thereby urge the first ends inwards and into said closed position.

3. The lock according to claim 2, wherein said first pair of engagement surfaces are formed by a pair of catches located on opposing sides of said locking pin, and wherein said second pair of engagement surfaces are formed by a pair of opposing pivotably-mounted cam followers.

4. The lock according to claim 1, wherein said receiver assembly includes first and second support brackets fixed to said top corner fitting, wherein said first and second swing arms are pivotally mounted to said first and second brackets.

5. The lock according to claim 4, wherein each said pin assembly further includes a guide flange and a second biasing member, said locking pin being sized to slide within said flange and move between a fully extended position and a retracted position, said locking pin and said flange including cooperating mechanical structure to limit downward translation of said locking pin beyond said fully extended position, said second biasing member urging said locking pin to said fully extended position.

6. The lock according to claim 5, wherein said guide flange is secured to said bottom corner fitting thereby capturing said locking pin within said bottom corner fitting.

7. The lock according to claim 6, wherein said guide flange includes a pair of opposing blocks and said locking pin includes a pair of cooperating shoulders which contact said blocks thereby limiting travel of said locking pin beyond said fully extended position.

8. The lock according to claim 6, further comprising a dowel for pivotably connecting each of said first and second swing arms to said brackets, and wherein one end of said dowel is supported by a wall of said top corner fitting.

9. The lock according to claim 6, wherein each of said cam followers includes an annular ring rotatably mounted to said first end of said swing arm.

10. The lock according to claim 9, wherein said first biasing member includes a shaft and a stack of disc springs, said disc springs being supported by and carried on said shaft.

11. The lock according to claim 10, wherein said second biasing member includes a pair of coiled springs.

12. The lock according to claim 6, wherein said first and second support brackets include a threaded shaft sized to penetrate the wall of said top corner fitting, and wherein each said receiver assembly further includes at least one seal and at least one nut for securing each of said brackets to said upper fitting in a weather-resistant manner.

13. The lock according to claim 6, wherein said pair of catches are provided by notches formed in opposing sides of said locking pin.

* * * * *